US010781017B2

(12) United States Patent
Sakimura et al.

(10) Patent No.: US 10,781,017 B2
(45) Date of Patent: Sep. 22, 2020

(54) CAP AND DISCHARGE CONTAINER

(71) Applicants: TOKYO LIGHT INDUSTRY CO., LTD., Tokyo (JP); KYORAKU CO., LTD., Kyoto (JP)

(72) Inventors: Takaaki Sakimura, Tokyo (JP); Masashi Sasaki, Tokyo (JP); Shouji Uehira, Tokyo (JP); Satoshi Ichikawa, Tokyo (JP)

(73) Assignees: TOKYO LIGHT INDUSTRY CO., LTD., Tokyo (JP); KYORAKU CO., LTD., Kyoto (JP)

( * ) Notice: Subject to any disclaimer, the term of this patent is extended or adjusted under 35 U.S.C. 154(b) by 151 days.

(21) Appl. No.: 16/302,239

(22) PCT Filed: Apr. 24, 2017

(86) PCT No.: PCT/JP2017/016210
§ 371 (c)(1),
(2) Date: Nov. 16, 2018

(87) PCT Pub. No.: WO2017/199697
PCT Pub. Date: Nov. 23, 2017

(65) Prior Publication Data

US 2019/0291930 A1 Sep. 26, 2019

(30) Foreign Application Priority Data

May 20, 2016 (JP) ..... 2016-101804

(51) Int. Cl.
*B65D 47/24* (2006.01)
*B65D 41/16* (2006.01)
(Continued)

(52) U.S. Cl.
CPC ..... *B65D 47/24* (2013.01); *B65D 1/02* (2013.01); *B65D 41/165* (2013.01); *B65D 47/08* (2013.01);
(Continued)

(58) Field of Classification Search
CPC . B65D 1/32; B65D 1/02; B65D 35/46; B65D 41/165; B65D 47/0804;
(Continued)

(56) References Cited

U.S. PATENT DOCUMENTS 4,139,124 A * 2/1979 Ferrante ..... B65D 83/0094 222/110
5,154,328 A * 10/1992 Gueret ..... A45D 34/04 222/494
(Continued)

FOREIGN PATENT DOCUMENTS

JP 2013151316 A 8/2013
JP 2014125268 A 7/2014
(Continued)

OTHER PUBLICATIONS

International Search Report dated May 30, 2017 filed in PCT/JP2017/016210.

*Primary Examiner* — Patrick M. Buechner
(74) *Attorney, Agent, or Firm* — Rankin, Hill & Clark LLP

(57) ABSTRACT

Provided is a cap (11) used for a discharge container (1) and provided on a mouth portion (32) of a container main body (10) which is deformed by a pressing force and stores contents (100). The cap (11) includes: a base portion (51) having an annular bottom wall (64) having a discharge port (64*a*), an annular groove (64*c*) provided in an outer peripheral edge of the bottom wall (64), a flow port (64*d*) provided in the groove (64*c*), and a flow groove (64*e*) connected to the
(Continued)

flow port (64*d*); a check valve (53) having a cylindrical support portion (81) having one end disposed in the groove (64*c*), a plurality of elastic pieces (82) connected to the support portion (81), and a valve body (83) connected to the plurality of elastic pieces (82) and opening and closing the discharge port (64*a*); and a discharge nozzle (52) covering the bottom wall (64).

12 Claims, 17 Drawing Sheets

(51) Int. Cl.
*B65D 47/08* (2006.01)
*B65D 47/40* (2006.01)
*B65D 1/02* (2006.01)

(52) U.S. Cl.
CPC ..... *B65D 47/40* (2013.01); *B65D 2251/10* (2013.01); *B65D 2251/20* (2013.01)

(58) Field of Classification Search
CPC ..... B65D 47/24; B65D 47/2018; B65D 47/2031; B65D 47/205; B65D 47/2056; B65D 47/32; B65D 47/40; B65D 2251/10; B65D 2251/20
See application file for complete search history.

(56) References Cited

U.S. PATENT DOCUMENTS 5,379,919 A * 1/1995 Gueret ..... A45D 34/04 222/108
6,315,160 B1 * 11/2001 Gaiser ..... B65D 47/06 222/1
6,951,295 B1 * 10/2005 Gaus ..... B05B 11/007 222/484
2005/0098589 A1 * 5/2005 Felten ..... B65D 47/2093 222/481.5
2005/0103801 A1 * 5/2005 Felten ..... B65D 47/2093 222/94
2006/0071040 A1 * 4/2006 Young ..... B65D 47/268 222/484
2011/0290824 A1 * 12/2011 Smith ..... B65D 51/2864 222/135
2014/0144938 A1 5/2014 Kakuta et al.
2015/0001260 A1 1/2015 Hoshino
2015/0208838 A1 * 7/2015 Parker ..... F16K 15/144 220/714
2015/0353245 A1 12/2015 Sakimura et al.
2016/0137363 A1 * 5/2016 Wieder ..... B65D 47/06 215/229
2016/0145015 A1 * 5/2016 Hoshino ..... B65D 1/0215 222/130
2020/0031564 A1 * 1/2020 Nakahashi ..... B65D 1/0207

FOREIGN PATENT DOCUMENTS

JP 2015155333 A 8/2015
JP 2016037290 A 3/2016

* cited by examiner

CAP AND DISCHARGE CONTAINER

TECHNICAL FIELD

The present invention relates to a cap and a discharge container which are opened and closed by a pressure inside the container.

BACKGROUND ART

Conventionally, as a discharge container for discharging stored contents, a structure including a container main body having an inner container with high flexibility and an outer container in which the inner container is furnished, and a cap which is attached to a mouth portion of the container main body and has a check valve and a discharge nozzle has been known. Such a discharge container is referred to as a so-called double container. This container has an intake valve in the outer container. Then, the outer container is deformed by a pressing force, whereby the inner container is compressed. Thus, the contents are discharged from the discharge nozzle.

Further, after the contents of the discharge container are discharged, since the outer container is restored, air is supplied from the intake valve to between the outer container and the inner container. Thus, restoration of the inner container of the discharge container is suppressed as much as possible. In this way, entry of air into the inner container is prevented. When a lid body provided in the cap of the discharge container is closed, a sealing ring provided in an inner surface of the lid body and an opening portion of the discharge nozzle are fitted to each other. Thus, the inner container is sealed.

However, in such a discharge container, when the check valve of the discharge nozzle is closed after the contents are discharged, the contents remain in the discharge nozzle. Then, the remaining contents remain at a tip end of the discharge nozzle. As a result, there is a possibility of liquid dripping from the tip end. Further, when the lid body is closed, the sealing ring is fitted with a discharge port of the discharge nozzle, and the remaining contents located at the discharge port overflow. As a result, an interior of the cap may be contaminated.

Therefore, as described in JP-A-2015-155333, there is known a discharge container which suppresses leakage of the contents remaining in the discharge nozzle after discharging the contents. This discharge container is provided with a valve seat on which a valve body of the check valve abuts in the discharge nozzle. At the same time, the valve seat is provided with a flow groove allowing the contents to flow therethrough. With such a structure, the contents remaining in an inner plug member returns from the flow groove into the inner container. Thus, the discharge container suppresses liquid dripping and contamination of the cap due to the contents remaining in the discharge nozzle.

SUMMARY OF THE INVENTION

In the above-described discharge container, the flow groove is provided between the valve body and the valve seat. Thus, an opening of the discharge nozzle and the flow groove are close to each other. Therefore, when the discharge container is tilted so that the discharge nozzle faces downward, there is a possibility that the contents of the inner container drips from the flow groove and the opening of the discharge nozzle.

Therefore, an object of the present disclosure is to provide a cap and a discharge container which can prevent liquid dripping when used.

DESCRIPTION OF THE EMBODIMENTS

First Embodiment

Hereinafter, a structure of a discharge container 1 according to a first embodiment of the present invention will be described with reference to FIGS. 1 to 6.

Figure 1:
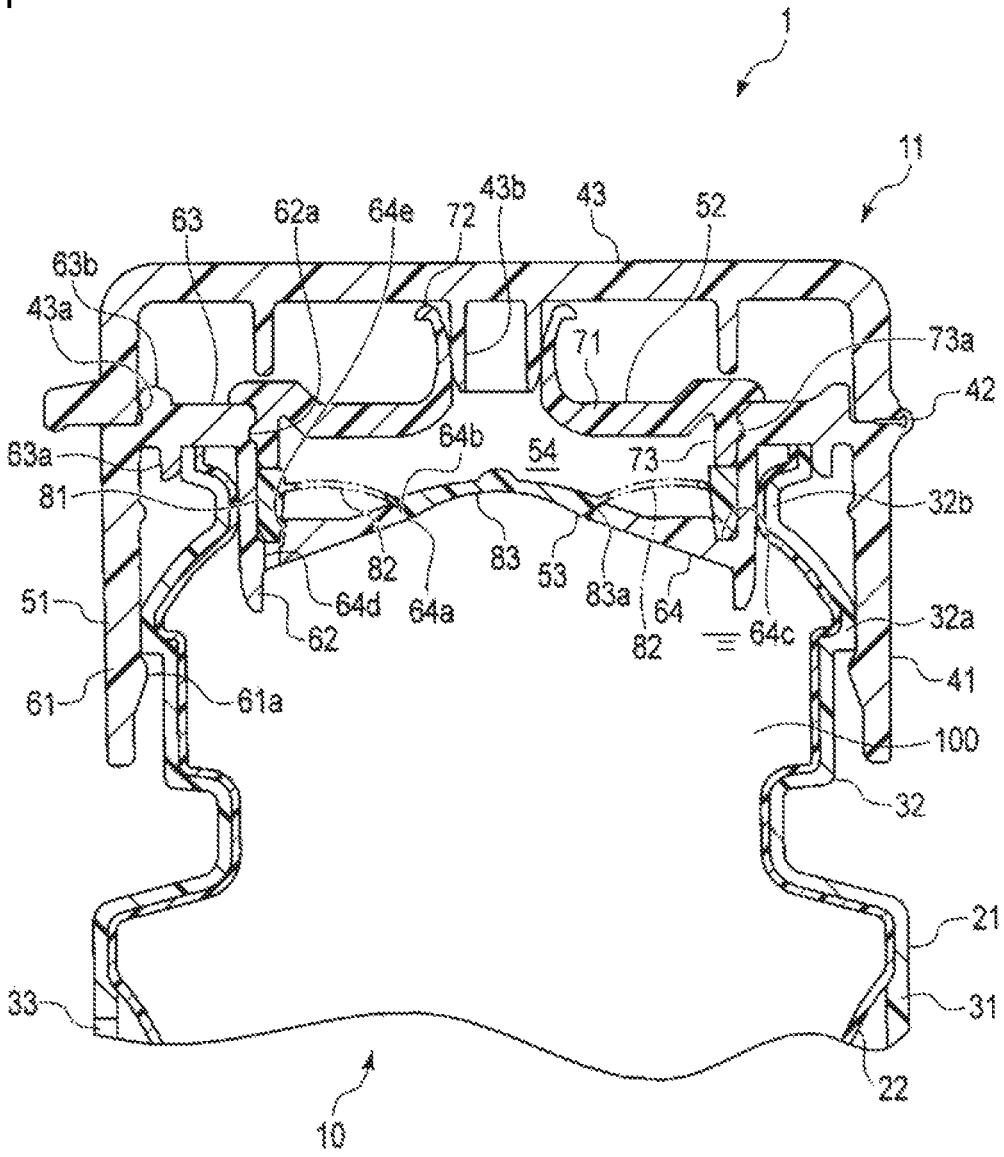
FIG. 1 is a cross-sectional view showing a structure of a discharge container according to a first embodiment of the present invention.
Figure 2:
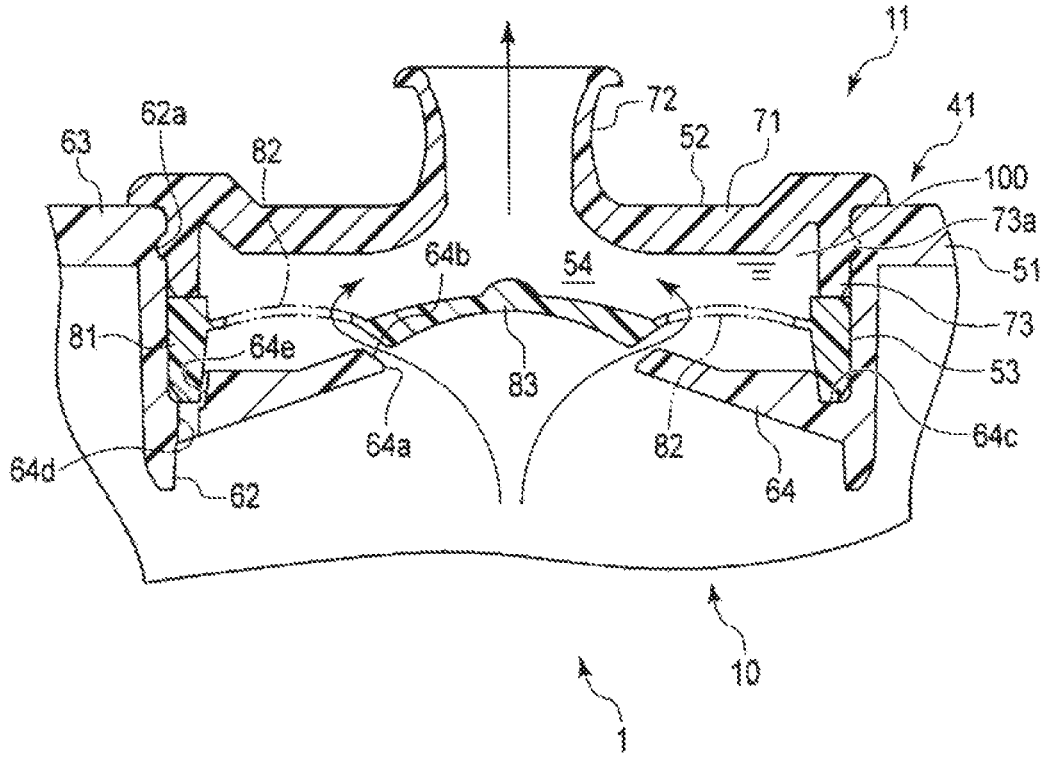
FIG. 2 is a cross-sectional view showing a structure of a cap used for the discharge container.
Figure 3:
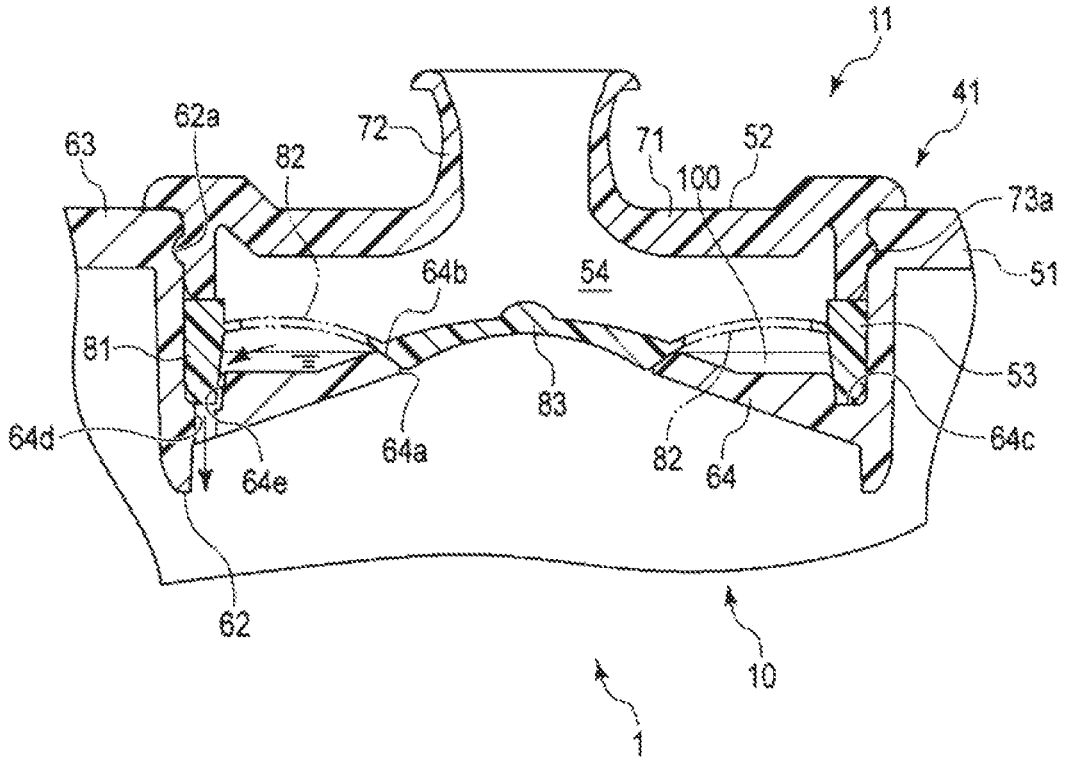
FIG. 3 is a cross-sectional view showing the structure of the cap.
Figure 4:
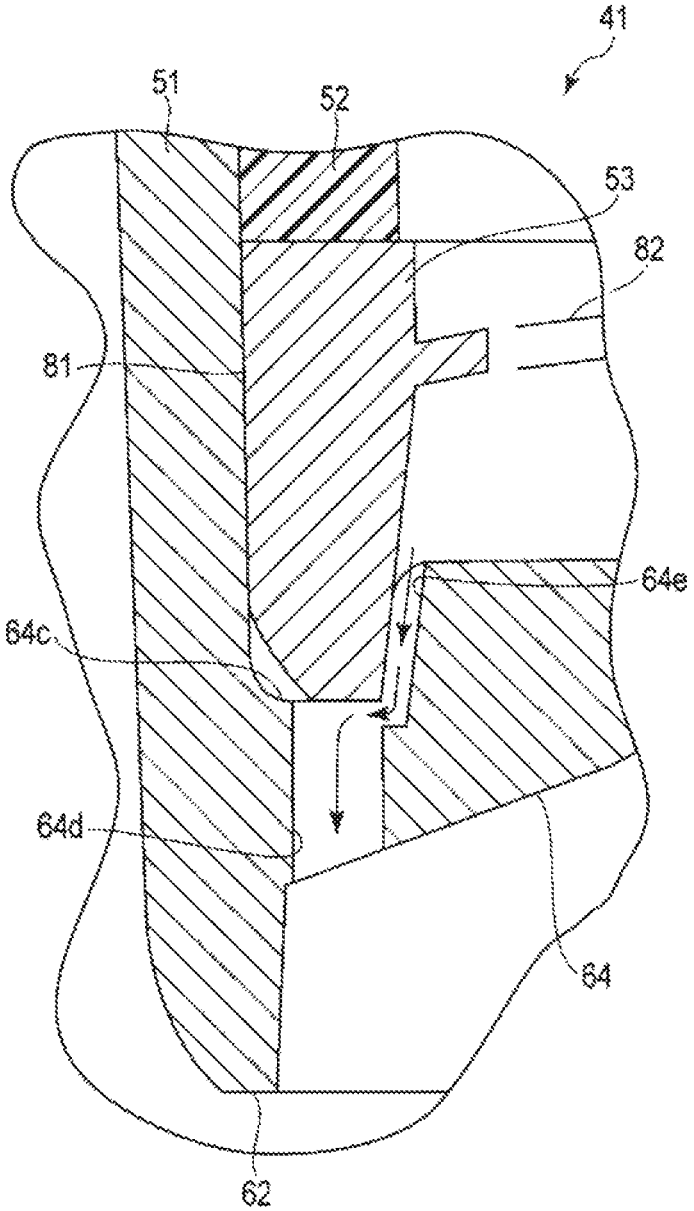
FIG. 4 is an enlarged cross-sectional view of a structure of a main part of the cap.
Figure 5:
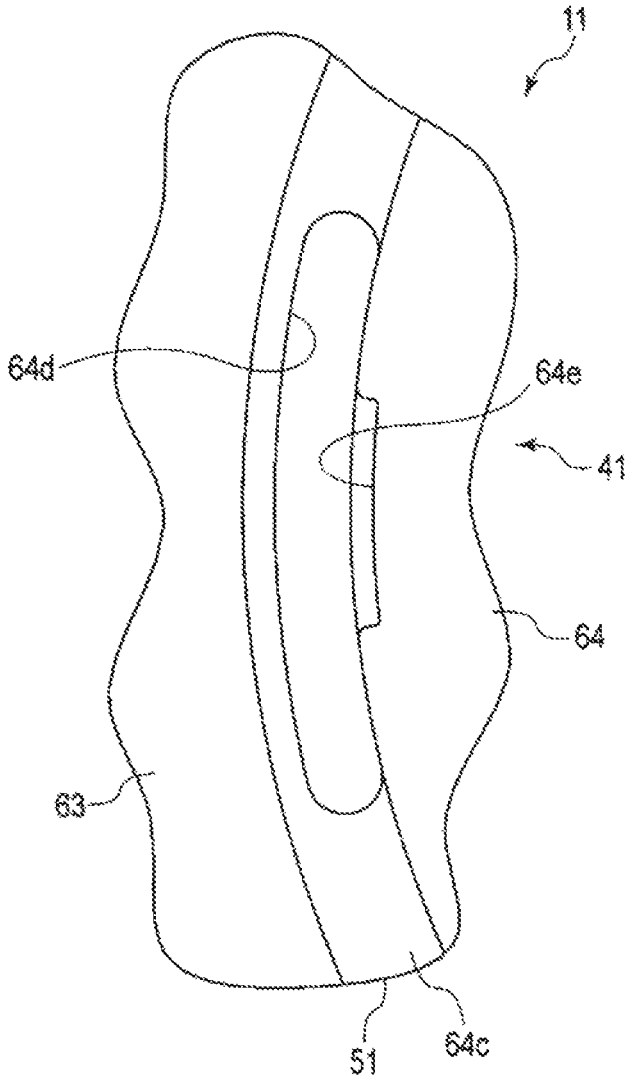
FIG. 5 is a plan view showing the structure of the main part of the cap.
Figure 6:
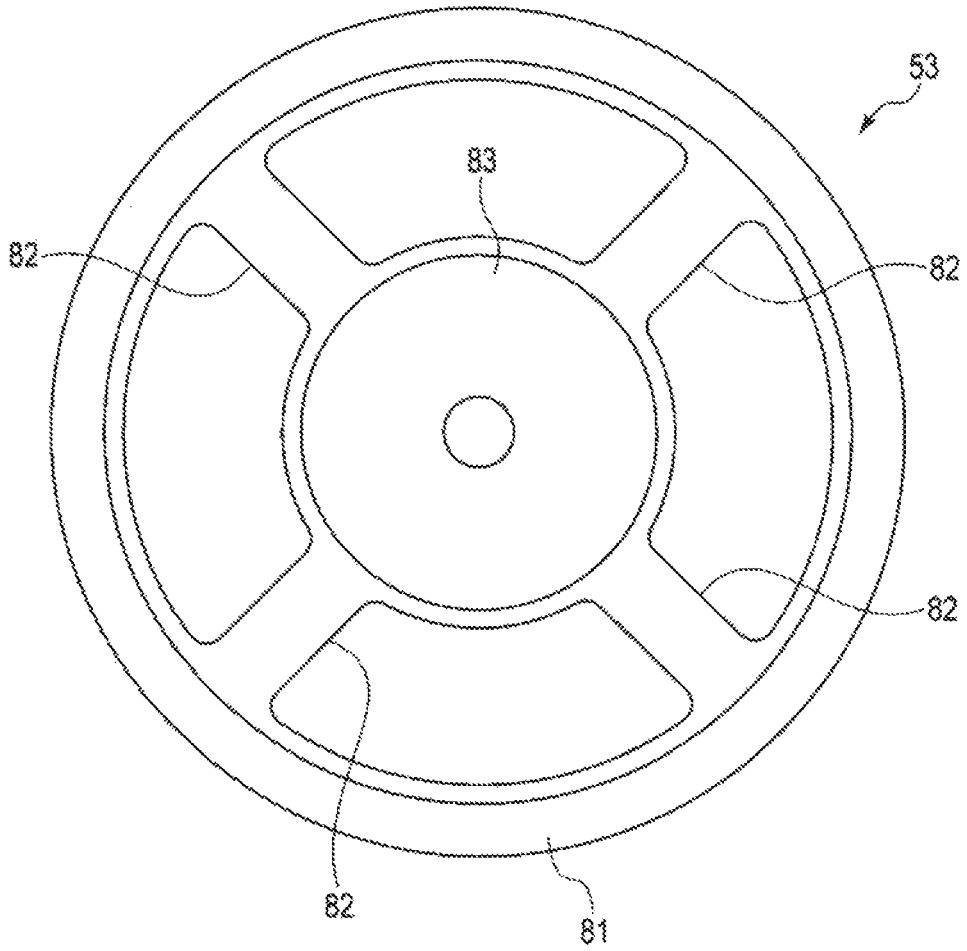
FIG. 6 is a plan view showing a structure of a check valve used for the cap.

FIG. 1 is a cross-sectional view partially omitting a structure of the discharge container 1 according to the first embodiment of the present invention. FIG. 2 is a cross-sectional view showing a structure of a cap 11 used for the discharge container 1 and a state of discharging contents 100. FIG. 3 is a cross-sectional view showing the structure of the cap 11 and a state after discharging the contents 100. FIG. 4 is an enlarged cross-sectional view showing a structure of a flow port 64*d*, a flow groove 64*e*, and a support portion 81 of a check valve 53 of a cap main body 41 of the cap 11. At the same time, FIG. 4 shows an example of a flow of the contents 100 by arrows. FIG. 5 is a plan view showing the structure of the flow port 64*d* and the flow groove 64*e* of the cap main body 41 used for the cap 11. FIG. 6 is a plan view showing a structure of the check valve 53 used for the cap 11.

As shown in FIG. 1, the discharge container 1 includes a container main body 10 and the cap 11. The discharge container 1 stores liquid contents 100 in the container main body 10. At the same time, the discharge container 1 is configured to discharge an appropriate amount of the contents 100 by applying a pressing force to the container main body 10 to deform the container.

Here, examples of the contents 100 include edible oils such as soy sauce, olive oil, and salad oil, ponzu sauce, sauce, soup stock, lotion, and liquids such as shampoo and rinse.

The container main body 10 is formed in a bottomed tubular shape in which the cap 11 is fixed to an opening end thereof. The container main body 10 is, for example, a so-called double container which is peelable. The container main body 10 is constituted by, for example, an exterior and an interior peelably laminated on an inner surface of the exterior, which are formed by multilayer blow molding. Specifically, the container main body 10 includes an outer container 21 having a bottomed tubular shape, and a bag-like inner container 22 which is integrally provided in the outer container 21 and partly peeled off from the outer container 21.

The container main body 10 includes a body portion 31 having a bottomed tubular shape and a cylindrical mouth portion 32 integrally provided in continuation with the body portion 31. The container main body 10 further includes an intake valve 33.

The mouth portion 32 is integrally provided continuously with an end portion of the body portion 31. The mouth portion 32 has a first protuberance 32*a* formed in a middle portion thereof and projecting outwardly in an annular shape and a second protuberance 32*b* formed slightly closer to the body portion 31 side than an end portion thereof and projecting inwardly in an annular shape toward a center thereof.

An intake valve 33 capable of sucking air is formed between the outer container 21 and the inner container 22. That is, the intake valve 33 opens when a pressure between the body portion 31 and the inner container 22 is a negative pressure lower than the atmospheric pressure. Thus, the air is supplied to a space between the body portion 31 and the inner container 22.

The outer container 21 is formed of, for example, a resin material such as polyethylene and polypropylene. The outer container 21 is configured to be elastically deformable by the pressing force.

The inner container 22 is made of a resin material having no compatibility with the resin material constituting the outer container 21. The inner container 22 is formed to be thinner than the outer container 21. Therefore, the inner container 22 has high flexibility. The inner container 22 is formed in a bag shape and can contain the contents 100.

The cap 11 includes a cap main body 41 and a lid body 43 connected to the cap main body 41 via a hinge 42. A part of the cap main body 41, the hinge 42, and the lid body 43 of the cap 11 are integrally formed by injection molding.

The cap main body 41 includes a base portion 51 fixed to the mouth portion 32, a discharge nozzle 52 provided in the base portion 51, and the check valve 53 provided between the base portion 51 and the discharge nozzle 52. Further, the cap main body 41 has a valve chamber 54 capable of housing the check valve 53 and allowing the check valve 53 to move between the base portion 51 and the discharge nozzle 52.

The base portion 51 is integrally formed with the hinge 42 and the lid body 43. The base portion 51, the hinge 42, and the lid body 43 are made of, for example, polypropylene. The base portion 51 includes a cylindrical outer tube 61, an inner tube 62 configured to have an outer diameter smaller than an inner diameter of the outer tube 61, an annular plate-like wall portion 63 continuous with one end portions of the outer tube 61 and the inner tube 62, and an annular plate-like bottom wall 64 provided at the other end portion of the inner tube 62.

The outer tube 61 is configured to have an inner diameter substantially equal to an outer diameter of the first protuberance 32*a* of the mouth portion 32. The outer tube 61 has an annular protrusion 61*a* engaged with the first protuberance 32*a* on an inner peripheral surface on an opening end portion side of the outer tube 61. The inner tube 62 has an annular recess 62*a* on an inner peripheral surface on the wall portion 63 side of the inner tube 62.

The wall portion 63 has an annular protrusion 63*a* on a main surface between the outer tube 61 and the inner tube 62. The annular protrusion 63*a* has an inner diameter substantially equal to an outer diameter of the end portion of the mouth portion 32. The wall portion 63 has a hinge 42 provided in a part of an outer peripheral edge thereof, more specifically at a part of a ridge portion with an outer peripheral surface of the outer tube 61. Further, the wall portion 63 has a projecting engaging portion 63*b*. The engaging portion 63*b* is, for example, a protrusion projecting in an axial direction from the main surface of the wall portion 63 and having an apex portion projecting outward in a radial direction.

The bottom wall 64 is formed in an annular shape. The bottom wall 64 includes a discharge port 64*a* provided in the center in the radial direction, a valve seat 64*b* provided around the discharge port 64*a*, a groove 64*c* provided in an outer peripheral portion adjacent to the inner tube 62, a flow port 64*d* provided in the groove 64*c*, and a flow groove 64*e* provided in the groove 64*c* and continuous with the flow port 64*d*. The bottom wall 64 constitutes a valve seat portion including the valve seat 64*b*.

In the bottom wall 64, at least a part of a main surface or the whole main surface on the wall portion 63 side is inclined. Due to this inclination, a portion on the discharge port 64*a* side of the part of the main surface or the whole main surface is located closer to the wall portion 63 side than a portion on the groove 64*c* side thereof. That is, in the bottom wall 64, the valve seat 64*b* and the groove 64*c* are arranged at different positions in the axial direction. More specifically, when the discharge container 1 is in a so-called upright posture in which a bottom of the container main body 10 is positioned below and the cap 11 is positioned above, the valve seat 64*b* is disposed above the groove 64*c*. The valve seat 64*b* is configured, for example, so that an inner peripheral surface of the discharge port 64*a* is inclined with respect to the axial direction.

As shown in FIGS. 1 to 5, the groove 64*c* is a cylindrical recess and is formed so that a bottom surface thereof is an annular flat surface. The groove 64*c* has the arcuate flow port 64*d* and the flow groove 64*e* provided in the flow port 64*d*. The flow port 64*d* and the flow groove 64*e* constitute a channel for communicating the valve chamber 54 and an inside of the inner container 22 of the container main body 10.

The flow port 64*d* is provided at a bottom portion of the groove 64*c* and on an inner surface side on a radial center side of the groove 64*c*. For example, the flow port 64*d* is provided at a position opposite to the hinge 42 across a central axis of the cap main body 41. The flow port 64*d* is configured to have an opening area larger than the flow groove 64*e* and to have a size not closing the opening even when burrs are generated at the time of molding the base portion 51. For example, the flow port 64*d* is formed so that its radial width is less than the radial width of the groove 64*c*.

The flow groove 64*e* is an inner surface on the radial center side of the groove 64*c* and is provided at a center in a circumferential direction of the flow port 64*d*. The flow groove 64*e* is formed so that a depth from the main surface on the wall portion 63 side of the bottom wall 64 is deeper than that from the main surface to the bottom surface of the groove 64*c*. In other words, the flow groove 64*e* extends beyond the bottom surface of the groove 64*c* to the flow port 64*d*. The flow groove 64*e* constitutes the channel continuing from the valve chamber 54 to the flow port 64*d*. As a specific example, the flow groove 64*e* is continuous with an opening end opening at the groove 64*c* of the flow port 64*d*.

The flow groove 64*e* is formed so that a depth in the radial direction from the inner surface on the radial center side of the groove 64*c* is a predetermined depth. Here, the predetermined depth is a depth of the flow groove 64*e* in which the contents 100 can close a gap generated between an inner peripheral surface of the support portion 81 and the flow groove 64*e* when the support portion 81 to be described below of the check valve 53 is disposed in the groove 64*c*. At this time, air flow is prevented by a surface tension of the contents 100. Therefore, a depth in the radial direction of the flow groove 64*e* from an outer peripheral surface of the groove 64*c* is appropriately set by the contents 100 stored in the discharge container 1.

The discharge nozzle 52 includes a disk-shaped top wall portion 71 having an opening at a center thereof, a cylindrical nozzle portion 72 provided at a center of an opening of one main surface of the top wall portion 71, and a cylindrical portion 73 provided on an outer peripheral edge side of the other main surface of the top wall portion 71. The discharge nozzle 52 is made of, for example, polyethylene.

An outer diameter of the top wall portion 71 is configured to have a larger diameter than an inner diameter of the inner tube 62. An opening at a tip end of the nozzle portion 72 constitutes a discharge port of the contents 100 of the cap 11.

An outer diameter of the cylindrical portion 73 is smaller than the outer diameter of the top wall portion 71 and substantially the same diameter as the inner diameter of the inner tube 62. The cylindrical portion 73 has an annular protrusion 73*a* engaged with the recess 62*a* of the inner tube 62 on the outer peripheral surface. The cylindrical portion 73 is formed so that a length from a tip end thereof to the other main surface of the top wall portion 71 is equal to a difference between a length from the main surface of the wall portion 63 to the groove 64*c* and a length in the axial direction of the support portion 81. In other words, the cylindrical portion 73 is configured to have a length capable of contacting an end portion of the support portion 81 disposed in the groove 64*c* when the discharge nozzle 52 is assembled to the base portion 51.

As shown in FIGS. 1 to 3 and 6, the check valve 53 includes a cylindrical support portion 81, a plurality of elastic pieces 82 extending from the inner peripheral surface of the support portion 81 toward a central axis of the support portion 81, and a valve body 83 connected to the plurality of elastic pieces 82. The check valve 53 is made of, for example, polyethylene.

The support portion 81 is formed in a cylindrical shape. A part of its inner peripheral surface and the flow groove 64*e* constitute a predetermined channel. Both end surfaces in the axial direction of the support portion 81 are held by the bottom surface of the groove 64*c* of the base portion 51 and an end surface of the cylindrical portion 73 of the discharge nozzle 52.

The elastic piece 82 is formed in a strip-like small piece shape. The plurality of elastic pieces 82 are arranged at equal intervals on the inner peripheral surface of the support portion 81. In the present embodiment, four elastic pieces 82 are provided. The plurality of elastic pieces 82 form channels of the contents 100 between the adjacent elastic pieces 82. The plurality of elastic pieces 82 always urge the valve body 83 toward the valve seat 64*b*. The plurality of elastic pieces 82 are configured such that the valve body 83 can move in a direction away from the valve seat 64*b* when an internal pressure of the container main body 10 is higher than the atmospheric pressure and a pressure at which the valve body 83 initially moves is applied to the valve body 83.

The valve body 83 is formed in a circular shape and has a contact surface 83*a* which is in contact with the valve seat 64*b*. A surface direction of the contact surface 83*a* is configured in the same direction as a surface direction of the valve seat 64*b*.

The lid body 43 is integrally formed with the cap main body 41 via the hinge 42. The lid body 43 is formed in a bottomed cylindrical shape. The lid body 43 has a protruding engaged portion 43*a* provided on an inner peripheral surface thereof and engaging with the engaging portion 63*b*, and a sealing ring 43*b* provided in a main surface opposed to the discharge nozzle 52 and closing the nozzle portion 72. The sealing ring 43*b* is formed in a cylindrical shape. Further, the sealing ring 43*b* is configured to have an outer diameter substantially equal to an inner diameter of the nozzle portion 72.

Next, a method of using the discharge container 1 thus configured will be described.

First, the discharge container 1 filled with the contents 100 is kept, for example, in the upright posture in which the container main body 10 is below and the cap 11 is above. At the time of use, that is, when discharging the contents 100, the user first grips the discharge container 1, opens the lid body 43, and directs the nozzle portion 72 to a discharge destination. Next, the user presses the outer container 21 to apply the pressing force to the outer container 21 while discharging the contents 100.

Thus, the outer container 21 is elastically deformed. As the outer container 21 is elastically deformed, the air in a space between the outer container 21 and the inner container 22 is compressed. In this way, the pressing force is applied to the inner container 22. Thus, the inner container 22 is elastically deformed. Then, a pressure in the inner container 22 increases. When the pressure in the inner container 22 becomes higher than the atmospheric pressure and the pressure at which the valve body 83 initially moves is applied to the valve body 83, the valve body 83 is pressed by the contents 100 and separated from the valve seat 64*b*. Thus, as shown by an arrow in FIG. 2, the contents 100 moves from the discharge port 64*a* to the valve chamber 54 through a space between the adjacent elastic pieces 82. Then, the contents 100 are discharged from the nozzle portion 72. As the contents 100 are discharged from the nozzle portion 72, a volume of the inner container 22 decreases by a volume of the discharged contents 100.

Next, after the desired contents 100 are discharged, the user releases pressing of the outer container 21. The valve body 83 comes into contact with the valve seat 64*b* by restoring forces of the elastic pieces 82 by releasing the pressing of the outer container 21. Then, the outer container 21 is restored to its original shape. At this time, the inner container 22 is slightly restored. However, a restoring force of the inner container 22 is weak due to its high flexibility. Therefore, a shape of the outer container 21 is restored in a state in which a shape of the inner container 22 is maintained in substantially the same shape. Thus, the negative pressure is generated in the space between the outer container 21 and the inner container 22.

Thus, the air is sucked into the space between the outer container 21 and the inner container 22 from the intake valve 33 of the outer container 21. As a result, in a state in which the shape of the inner container 22, in other words, the volume of the inner container 22 is maintained at substantially the same volume, strictly speaking, in a state in which the volume of the inner container 22 slightly increases due to slight restoration of the inner container 22, the atmospheric pressure and a pressure in the space between the outer container 21 and the inner container 22 become the same.

Here, the slight restoration of the inner container 22 occurs due to a phenomenon that suction of the air from the intake valve 33 to the space between the outer container 21 and the inner container 22 does not catch up with a restoration speed of the outer container 21 at the time of restoration of the outer container 21.

Further, due to the slight restoration of the inner container 22, as indicated by arrows in FIG. 3, the contents 100 remaining in the valve chamber 54 and the nozzle portion 72 move from the valve chamber 54 to the inner container 22 side through the flow groove 64*e* and the flow port 64*d*. The contents 100 remaining in the valve chamber 54 and the nozzle portion 72 remain at least in the flow groove 64*e* by an amount of sealing the flow groove 64*e* by the surface tension. In this way, liquid suction occurs in which only the contents 100 are sucked into the inner container 22 without sucking the air.

Here, the flow groove 64*e* is provided on the inner side on the radial center side of the groove 64*c*, and extends beyond the bottom surface of the groove 64*c* to the flow port 64*d*. Further, the flow groove 64*e* is not provided up to an opening end on the inner container 22 side of the flow port 64*d*. Therefore, when an example of movement of the contents 100 is described in detail, as indicated by arrows in FIG. 4, the contents 100 first move toward the inner container 22 through the flow groove 64*e*. At the same time, the contents 100 move in the radial direction at an end portion of the flow groove 64*e*. Thereafter, the contents 100 move toward the inner container 22 along the flow port 64*d*. That is, the contents 100 move toward the inner container 22 substantially in the axial direction of the outer container 21. At the same time, the contents 100 move in a direction perpendicular to the axial direction on the way. However, the contents 100 again move substantially in the axial direction and return to the inner container 22.

With the discharge container 1 structured as described above, the contents 100 remaining in the valve chamber 54 after discharging the contents 100 move to the inner container 22 side through the flow groove 64*e* and the flow port 64*d* due to the negative pressure of the inner container 22, which is generated by the slight restoration of the shape of the inner container 22 in accordance with the restoration of the outer container 21.

Thereafter, the contents 100 in an amount capable of sealing the flow groove 64*e* remain at least around the flow groove 64*e* in the valve chamber 54. Thus, the air is prevented from entering the inner container 22. For example, when the contents 100 in the valve chamber 54 are sucked by the liquid suction, the contents 100 remain only in the flow groove 64*e*. Then, the flow groove 64*e* is sealed by the surface tension of the contents 100. Thus, the air is prevented from entering the inner container 22. When the contents 100 remain in the valve chamber 54, the flow groove 64*e* is covered with the contents 100. Therefore, the air is prevented from entering the inner container 22.

As described above, the discharge container 1 can prevent the suction of the air at the time of the liquid suction, and the contents 100 are positioned in the flow groove 64*e* after the liquid suction, so that it is possible to prevent the air from entering the inner container 22 during storage.

Further, the discharge container 1 is hermetically sealed by the contents 100 remaining in the flow groove 64*e*. As a result, it is possible to prevent the air from entering the inner container 22 from the flow groove 64*e* during discharge and storage of the contents 100.

Further, the flow port 64*d* and the flow groove 64*e* are provided in an outer peripheral edge of the bottom wall 64, in other words, on an outer peripheral edge side of the valve chamber 54. Furthermore, the groove 64*c* is positioned lower than the valve seat 64*b* in an upright state of the discharge container 1. Thus, when the discharge container 1 is returned to the upright posture after discharging the contents 100, since the groove 64*c* is positioned below the valve chamber 54, the contents 100 remaining in the valve chamber 54 remain in the flow groove 64*e*.

As a result, even after the liquid suction, the discharge container 1 can seal the flow groove 64*e* by the surface tension of the contents 100. In the upright state of the discharge container 1, the groove 64*c* is formed in the outer peripheral portion lower than a central portion of the bottom wall 64. Therefore, the contents 100 remaining in the valve chamber 54 after the liquid suction accumulate in the vicinity of the groove 64*c* in the upright state. Therefore, even when the nozzle portion 72 faces downward, the contents 100 remaining in the valve chamber 54 move from the vicinity of the groove 64*c* far from the nozzle portion 72 toward the nozzle portion 72. Thus, it is possible to prevent the contents 100 remaining in the valve chamber 54 from dripping from the nozzle portion 72 before the next contents 100 are discharged from the nozzle portion 72.

In addition, the valve chamber 54 is constituted by the bottom wall 64 of the base portion 51, the top wall portion 71 and cylindrical portion 73 of the discharge nozzle 52, and the support portion 81 of the check valve 53. That is, the valve chamber 54 is a space having an inner diameter larger than the discharge port 64*a* and an opening of the nozzle portion 72. Therefore, when the discharge container 1 is in a posture in which the nozzle portion 72 is inclined downward, even if the contents 100 leak from the flow port 64*d* to the space of the valve chamber 54 through the flow groove 64*e*, the leaked contents 100 do not immediately drip from the nozzle portion 72 to the outside.

Further, the discharge container 1 is configured such that the flow port 64*d* and the flow groove 64*e* are provided at positions opposite to the hinge 42 across the central axis of the cap 11. In general, when using the discharge container 1, the nozzle portion 72 is directed to a discharge target, while the hinge 42 faces upward and the flow port 64*d* and the flow groove 64*e* face downward. Thus, it is possible to reliably position the contents 100 remaining in the valve chamber 54 in the flow port 64*d* and the flow groove 64*e*. Therefore, when the outer container 21 is restored, it is possible to reliably suck the contents 100 remaining after discharge.

Further, even when a function of the check valve 53 is reduced with use or aging due to a structure in which the flow groove 64*e* is provided in the groove 64*c* in which the support portion 81 is disposed, reduction of functions of the liquid suction and leakage does not occur.

More specifically, for example, in the case where the flow groove 64*e* is provided in the valve seat 64*b*, when an elastic force of the elastic piece 82 is reduced or the elastic piece 82 is deformed due to use or aging variation, a contact force of the valve body 83 to the valve seat 64*b* is reduced. In this case, when the discharge container 1 is in a posture in which the nozzle portion 72 faces downward, the check valve 53 becomes slightly opened due to own weight of the contents 100. As a result, there is a possibility that an amount of liquid leakage from the flow groove increases. However, by providing the flow groove 64*e* in the groove 64*c* as in the present embodiment, it is possible to maintain constant liquid suction and leakage without being affected by reduction of the function of the check valve 53 due to such use or aging variation.

As described above, according to the discharge container 1 according to the first embodiment of the present invention, it is possible to prevent liquid dripping during use by providing the flow port 64*d* and the flow groove 64*e* communicating in the valve chamber 54 and the container main body 10 in the groove 64*c* provided in the outer peripheral edge of the bottom wall 64 constituting the valve chamber 54.

Second Embodiment

Next, a structure of a discharge container 1A according to a second embodiment of the present invention will be described with reference to FIGS. 7 to 10.

Figure 7:
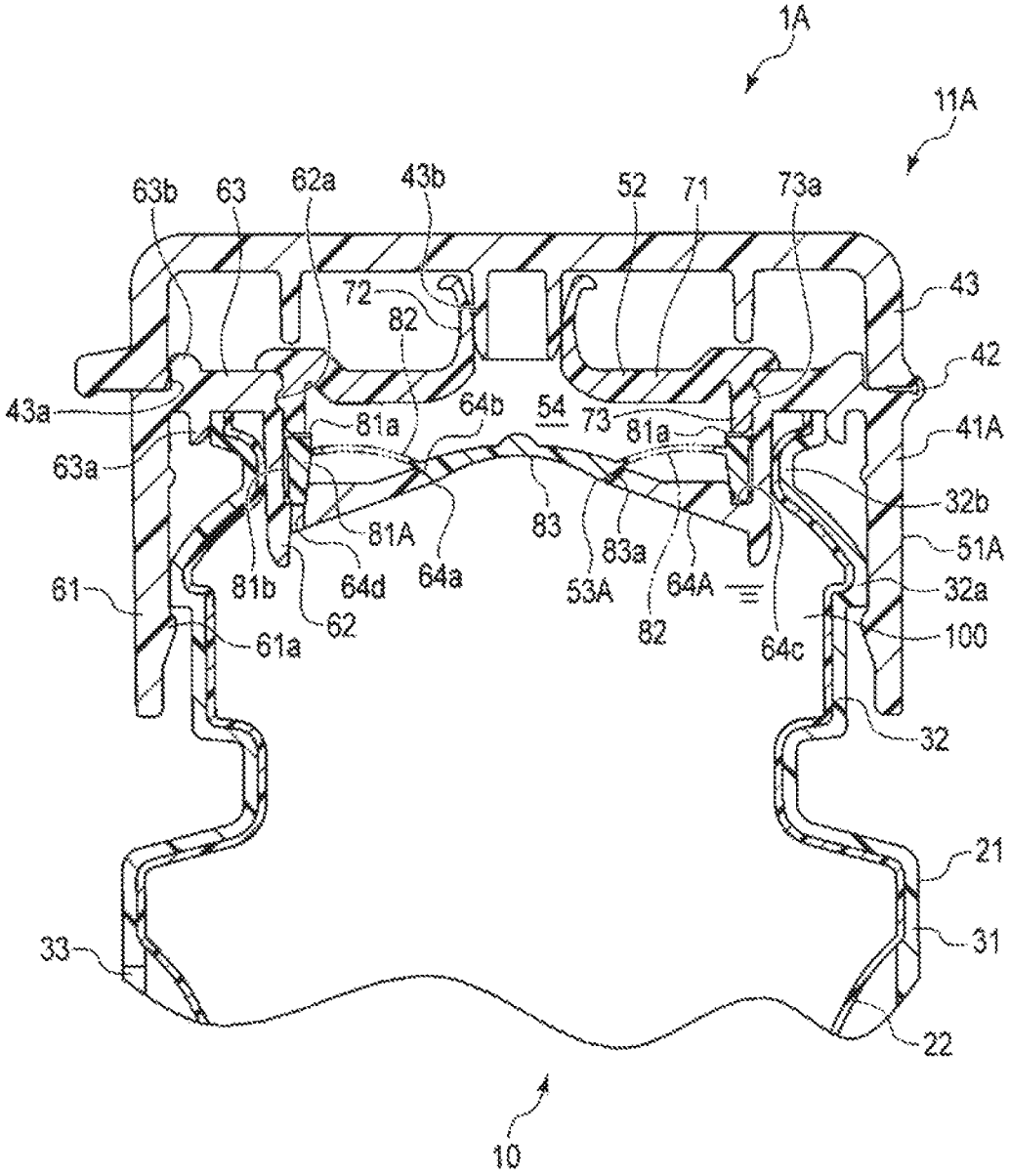
FIG. 7 is a cross-sectional view showing a structure of a discharge container according to a second embodiment of the present invention.
Figure 8:
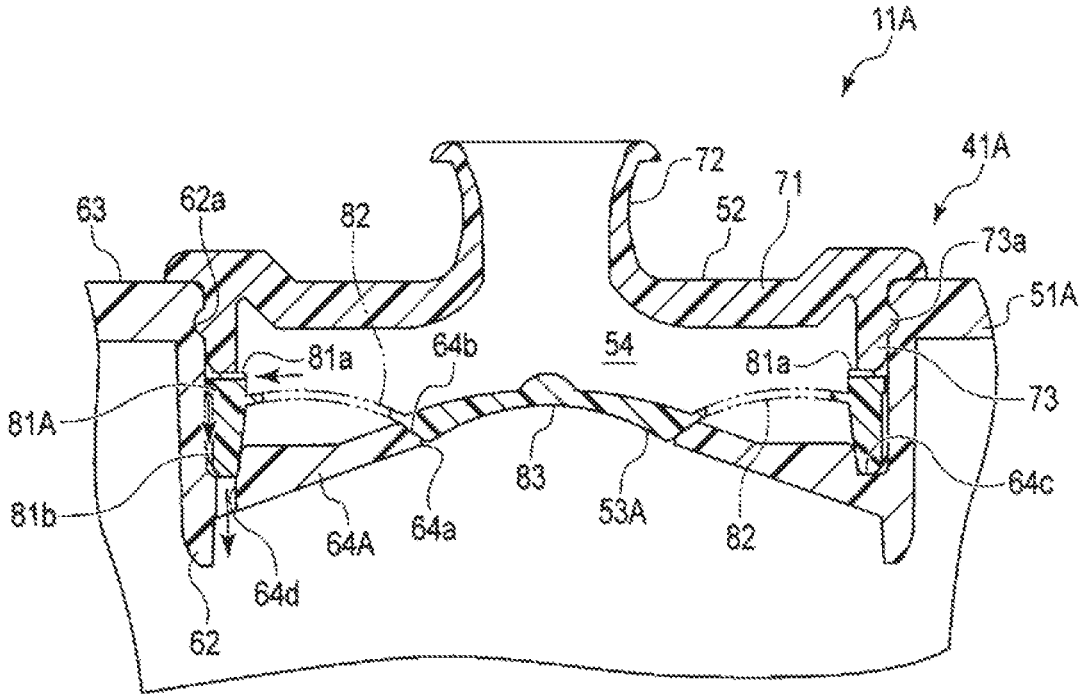
FIG. 8 is a cross-sectional view showing a structure of a cap used for the discharge container.
Figure 9:
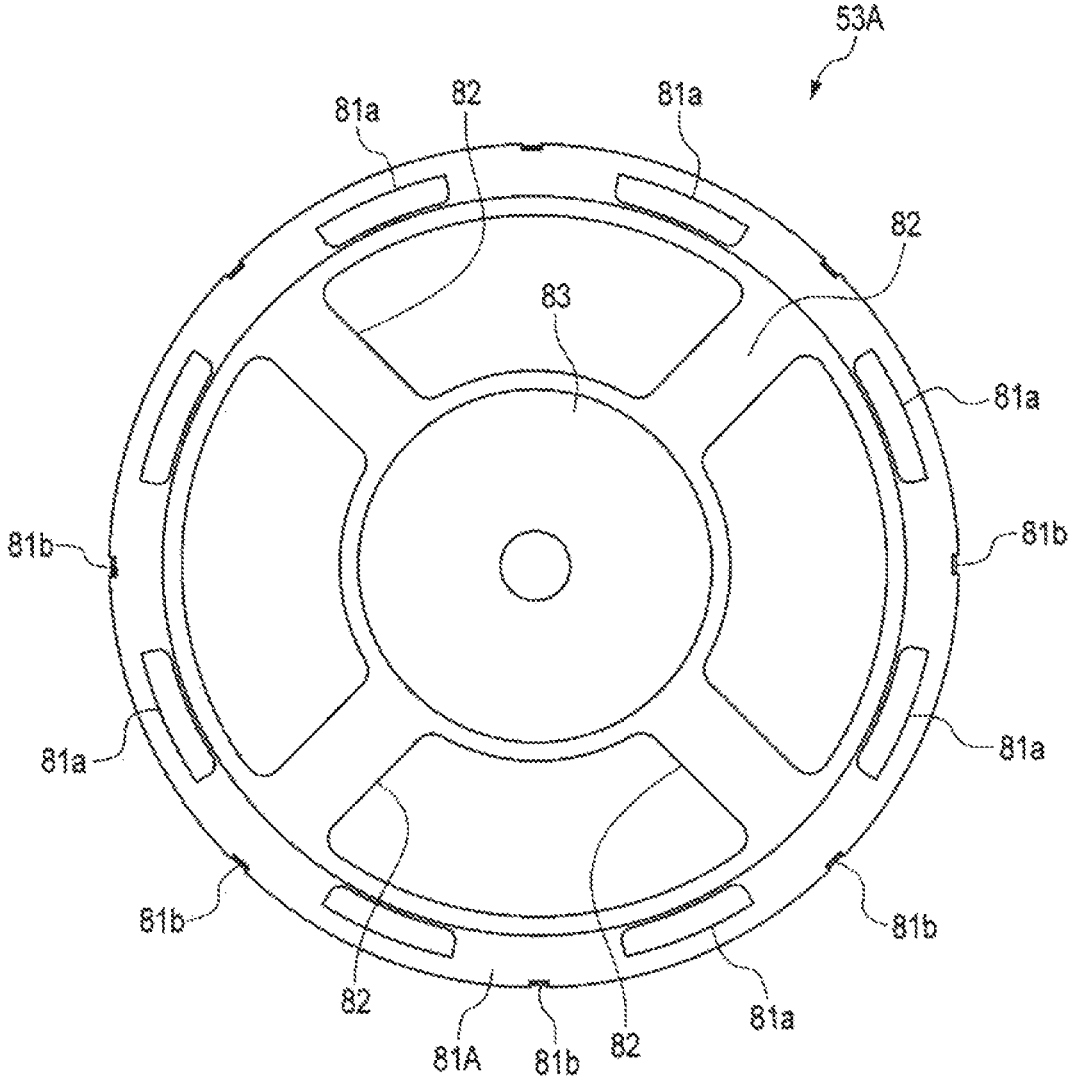
FIG. 9 is a plan view showing a structure of a check valve used for the cap.
Figure 10:
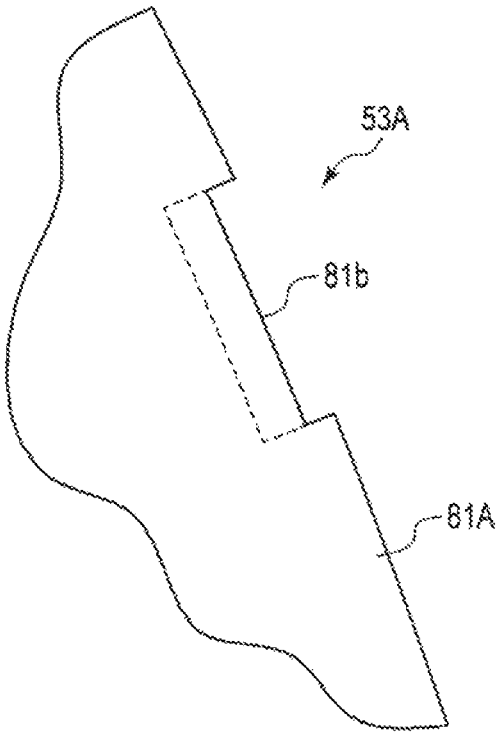
FIG. 10 is a plan view showing a structure of a main part of the check valve.

FIG. 7 is a cross-sectional view showing the structure of the discharge container 1A according to the second embodiment of the present invention. FIG. 8 is a cross-sectional view showing a structure of a cap 11A used for the discharge container 1A and a state after the contents 100 are discharged. FIG. 9 is a plan view showing a structure of a check valve 53A used for the cap 11A. FIG. 10 is an enlarged plan view showing a flow groove 81*b* of the check valve 53A. In the structure of the discharge container 1A according to the second embodiment, the same reference numerals are given to the same components as those of the discharge container 1 according to the first embodiment described above. Then, a detailed description thereof will be omitted.

As shown in FIG. 7, the discharge container 1A includes the container main body 10 and the cap 11A.

As shown in FIGS. 7 and 8, the cap 11A includes a cap main body 41A and the lid body 43 connected to the cap main body 41A via the hinge 42. A part of the cap main body 41A, the hinge 42, and the lid body 43 of the cap 11A are integrally formed by injection molding.

The cap main body 41A includes a base portion 51A fixed to the mouth portion 32, the discharge nozzle 52 provided in the base portion 51A, and the check valve 53A provided between the base portion 51A and the discharge nozzle 52. Further, the cap main body 41A has the valve chamber 54 capable of housing the check valve 53A and allowing the check valve 53A to move between the base portion 51 and the discharge nozzle 52.

The base portion 51A is integrally formed with the hinge 42 and the lid body 43. The base portion 51A, the hinge 42, and the lid body 43 are made of, for example, polypropylene. The base portion 51A includes the outer tube 61, the inner tube 62, the wall portion 63, and an annular plate-like bottom wall 64A provided at the other end portion of the inner tube 62.

The bottom wall 64A is formed in an annular shape. The bottom wall 64A includes the discharge port 64*a*, the valve seat 64*b*, the groove 64*c*, and the flow port 64*d*. That is, the bottom wall 64A is different from the bottom wall 64 of the cap 11 according to the first embodiment in that the bottom wall 64A does not have the flow groove 64*e* of the bottom wall 64.

Regarding the bottom wall 64A, similarly to the bottom wall 64 according to the first embodiment, the part or the whole of the main surface at least on the wall portion 63 side is inclined to the wall portion 63 side as it goes from the groove 64*c* to the discharge port 64*a*.

The flow port 64*d* is provided at the bottom portion of the groove 64*c* and opposite to the hinge 42 across the central axis of the cap main body 41. For example, the flow port 64*d* is formed so that its radial width is less than the radial width of the groove 64*c*.

As shown in FIGS. 7 to 10, the check valve 53A includes a cylindrical support portion 81A, the plurality of elastic pieces 82 extending from an inner peripheral surface of the support portion 81A toward the central axis of the support portion 81A, and the valve body 83 connected to the plurality of elastic pieces 82.

The support portion 81A is formed in a cylindrical shape. The support portion 81A is formed so that an outer diameter thereof is slightly larger than an inner diameter of the groove 64*c*. The support portion 81A has a plurality of spacer portions 81*a* integrally provided in an end surface opposed to the cylindrical portion 73 of the discharge nozzle 52, and one or a plurality of flow grooves 81*b* provided in an outer peripheral surface thereof. Further, the support portion 81A is provided at a ridge portion between an end surface of an end portion contacting the groove 64*c* and the outer peripheral surface. The support portion 81A has a chamfered portion formed with a curved surface having a predetermined radius of curvature over the entire circumference in the circumferential direction. This makes it possible to form a channel for communicating the flow groove 81*b* and the flow port 64*d* between the ridge portion and a corner portion radially outward of the groove 64*c*. Thus, the support portion 81A forms an annular channel over the entire circumference, which communicates the flow groove 81*b* and the flow port 64*d* together with the corner portion of the groove 64*c* at the ridge portion on the outer peripheral surface side.

The plurality of spacer portions 81*a* are provided at equal intervals in the circumferential direction on an end surface of the support portion 81A. A surface direction of a main surface of the spacer portion 81*a* is the same direction as a surface direction of the end surface of the support portion 81A. The main surface of the spacer portion 81*a* contacts the end surface of the cylindrical portion 73. The plurality of spacer portions 81*a* form channels of the contents 100 between adjacent spacer portions 81*a*.

The flow groove 81*b* is provided in the outer peripheral surface of the support portion 81A across both axial end surfaces of the support portion 81A. The flow groove 81*b* is provided at a position which is the outer peripheral surface of the support portion 81A and is opposed to the flow port 64*d* in the circumferential direction. Or, the plurality of flow grooves 81*b* are provided at equal intervals on the outer peripheral surface of the support portion 81A. In the present embodiment, eight flow grooves 81*b* are provided in the outer peripheral surface of the support portion 81A. Note that the number of the flow grooves 81*b* is not limited as long as the flow grooves 81*b* are configured to be fluidically continuous with the flow port 64*d* through a channel formed by the corner portion of the groove 64*c* and the ridge portion of the support portion 81A. That is, the flow groove 81*b* constitutes the channel continuing from the valve chamber 54 to the flow port 64*d*.

The flow groove 81*b* is formed so that a depth in the radial direction from the outer peripheral surface of the groove 64*c* is a predetermined depth. Here, the predetermined depth is a depth in which the contents 100 can close a gap generated between the inner peripheral surface of the support portion 81A and the flow groove 81*b* when the support portion 81A to be described below of the check valve 53A is disposed in the groove 64*c*. At this time, the air flow is prevented by the surface tension of the contents 100. The flow groove 81*b* is formed, for example, so that an end portion on the cylindrical portion 73 side of the support portion 81A has an opening sectional area in a direction perpendicular to the axial direction larger than the other portions. In other words, the flow groove 81*b* is formed so that a depth in the radial direction from the outer peripheral surface of the support portion 81A at the end portion on the cylindrical portion 73 side is less than the depth at the other portions.

With the discharge container 1A structured as described above, a channel is formed from the valve chamber 54 to the inner container 22 of the container main body 10 through between the adjacent spacer portions 81*a*, the flow groove 81*b*, a channel between the corner portion of the groove 64*c* and the ridge portion of the support portion 81A, and the flow port 64*d*. In this way, similarly to the above-described discharge container 1, the discharge container 1A is provided with the flow port 64*d* and the flow groove 81*b* for communicating the valve chamber 54 and an inside of the container main body 10, in the groove 64*c* provided in the outer peripheral edge of the bottom wall 64A constituting the valve chamber 54 and the support portion 81A of the check valve 53A. This makes it possible to prevent liquid dripping during use.

Further, the discharge container 1A is configured such that the flow groove 81*b* is provided in the outer peripheral surface of the support portion 81A and in a part between a side surface of the groove 63*c* and the outer peripheral surface of the support portion 81A. Furthermore, the discharge container 1A is configured such that the outer diameter of the support portion 81A is slightly larger than the inner diameter of the groove 64*c*. With this configuration, the outer peripheral surface of the support portion 81A excluding the flow groove 81*b* is brought into close contact with the inner peripheral surface of the groove 64*c*. Thus, with this configuration, it is easy to manage a channel cross-sectional area of the flow groove 81*b*. Accordingly, it is possible to easily obtain a desired channel cross-sectional area in the flow groove 81*b*.

As a result, the discharge container 1A can reliably and stably suck the contents 100 remaining in the valve chamber 54 from the flow groove 81*b*. Further, in the discharge container 1A, it is easy to set the depth of the flow groove 81*b* depending on characteristics of the contents 100. Further, air suction can be prevented as much as possible. Furthermore, the discharge container 1A can prevent liquid leakage from the flow groove 81*b* as much as possible in a posture in which the nozzle portion 72 is positioned downward.

Third Embodiment

Next, a structure of a discharge container 1B according to a third embodiment of the present invention will be described with reference to FIG. 11.

Figure 11:
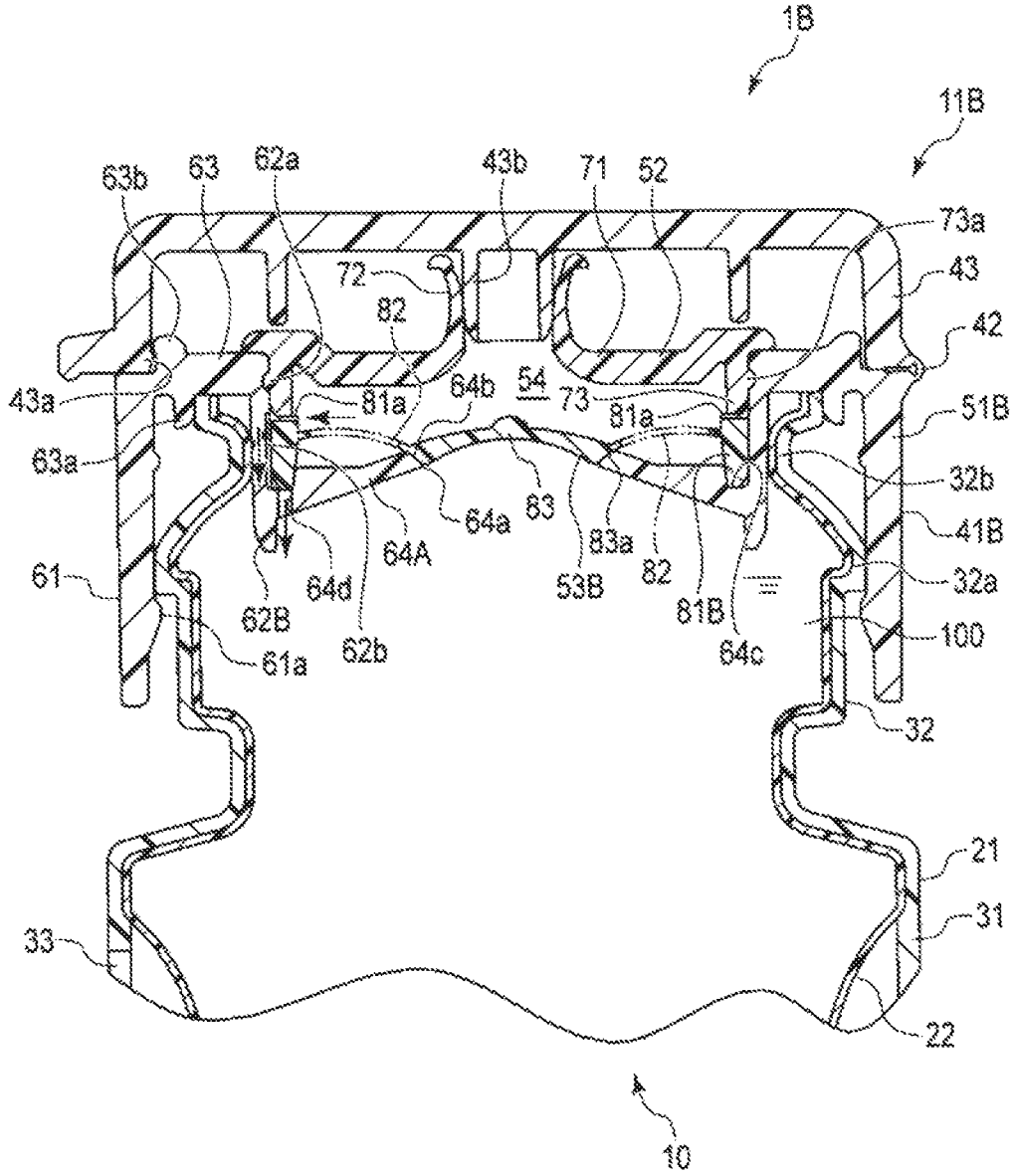
FIG. 11 is a cross-sectional view showing a structure of a discharge container according to a third embodiment of the present invention.

FIG. 11 is a cross-sectional view showing the structure of the discharge container 1B according to the third embodiment of the present invention. In the structure of the discharge container 1B according to the third embodiment, the same reference numerals are given to the same components as those of the discharge container 1 according to the first embodiment and those of the discharge container 1A according to the second embodiment, which are described above. Then, a detailed description thereof will be omitted.

As shown in FIG. 11, the discharge container 1B includes the container main body 10 and a cap 11B.

The cap 11B includes a cap main body 41B and the lid body 43 connected to the cap main body 41B via the hinge 42. A part of the cap main body 41B, the hinge 42, and the lid body 43 of the cap 11B are integrally formed by injection molding.

The cap main body 41B includes a base portion 51B fixed to the mouth portion 32, the discharge nozzle 52 provided in the base portion 51B, and a check valve 53B provided between the base portion 51B and the discharge nozzle 52. The cap main body 41B has the valve chamber 54 capable of housing the check valve 53B and allowing the check valve 53B to move between the base portion 51B and the discharge nozzle 52.

The base portion 51B is integrally formed with the hinge 42 and the lid body 43. The base portion 51B, the hinge 42, and the lid body 43 are made of, for example, polypropylene. The base portion 51B includes the outer tube 61, an inner tube 62B, the wall portion 63, and the annular plate-like bottom wall 64A provided at the other end portion of the inner tube 62B.

The inner tube 62B has a flow groove 62*b* at a side surface opposed to a support portion 81B to be described below of the check valve 53B and at a position adjacent to the flow port 64*d* of the bottom wall 64A. The flow groove 62*b* is provided from the groove 64*c* to an upper end of the support portion 81B. The flow groove 62*b* is fluidically continuous with the flow port 64*d*.

The flow groove 62*b* constitutes a channel for communicating from the valve chamber 54 to the flow port 64*d*. The flow groove 62*b* is formed so that a depth in the radial direction from an inner peripheral surface of the inner tube 62B is a predetermined depth. Here, the predetermined depth is a depth of the flow groove 62*b* in which the contents 100 can close a gap generated between an inner peripheral surface of the support portion 81B and the flow groove 62*b* when the support portion 81B of the check valve 53B is disposed in the groove 64*c*. At this time, the air flow is prevented by the surface tension of the contents 100.

The check valve 53B includes a cylindrical support portion 81B, a plurality of elastic pieces 82 extending from the inner peripheral surface of the support portion 81B toward the central axis of the support portion 81B, and the valve body 83 connected to the plurality of elastic pieces 82.

The support portion 81B is formed in a cylindrical shape. The support portion 81B has a plurality of spacer portions 81*a* integrally provided in the end surface opposed to the cylindrical portion 73 of the discharge nozzle 52. That is, the check valve 53B is configured not to have the flow groove 81*b* of the check valve 53A.

With the discharge container 1B structured as described above, a channel is formed from the valve chamber 54 to the inner container 22 of the container main body 10 through between the adjacent spacer portions 81*a*, the flow groove 62*b*, and the flow port 64*d*. In this way, the discharge container 1B is provided with the flow port 64*d* and the flow groove 62*b* for communicating the valve chamber 54 and the inside of the container main body 10, in the groove 64*c* provided in the outer peripheral edge of the bottom wall 64A constituting the valve chamber 54 and the support portion 81B of the check valve 53B. This makes it possible to prevent liquid dripping during use similarly to the above-described discharge containers 1 and 1A.

Fourth Embodiment

Next, a structure of a base portion 51C used in the discharge container 1 according to a fourth embodiment of the present invention will be described with reference to FIG. 12.

Figure 12:
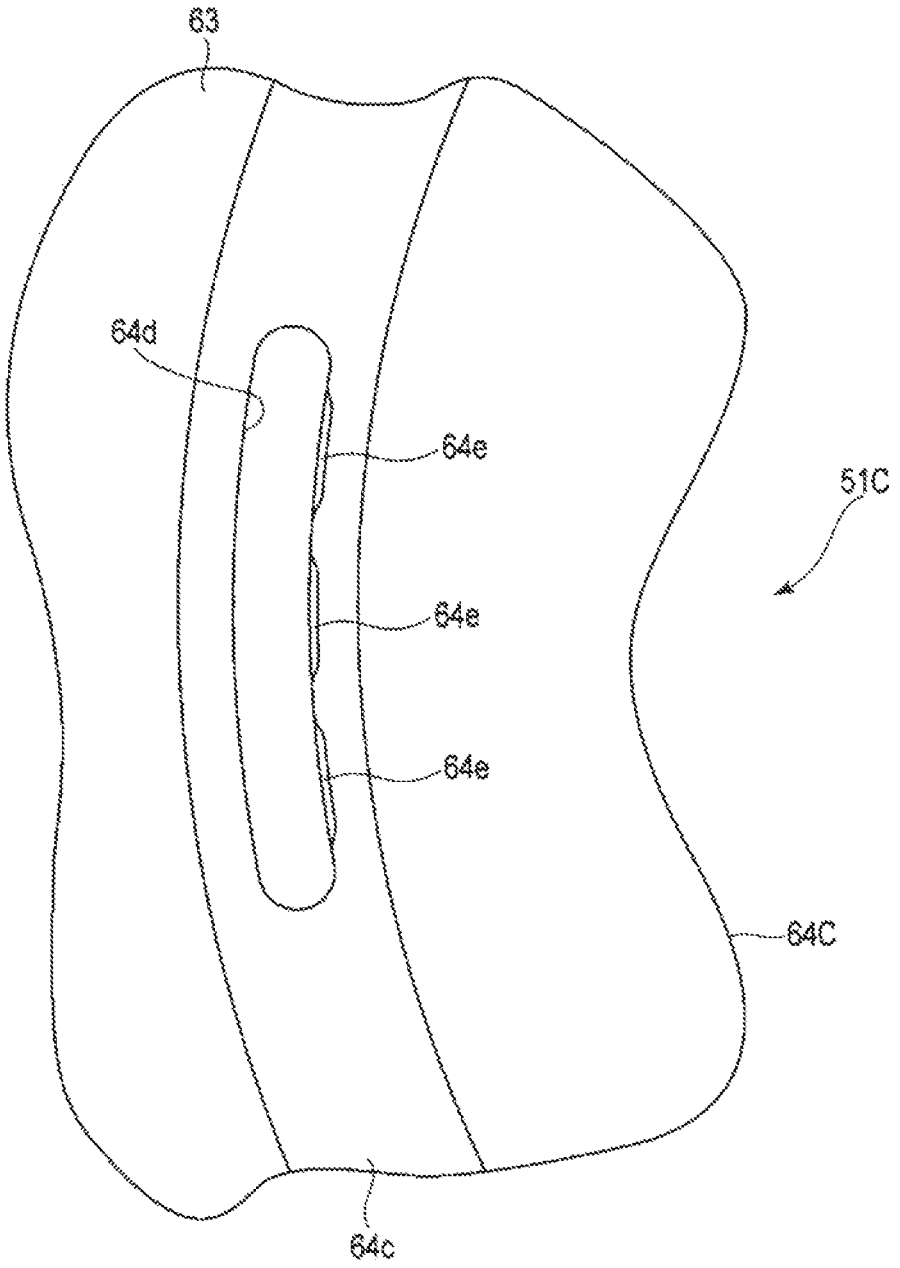
FIG. 12 is a plan view showing a structure of a base portion of a cap used for a discharge container according to a fourth embodiment of the present invention.

FIG. 12 is a plan view partially showing the structure of the base portion 51C used in the discharge container 1 according to the fourth embodiment of the present invention. In the structure of the discharge container 1 according to the fourth embodiment, the same reference numerals are given to the same components as those of the discharge container 1 according to the first embodiment described above. Then, a detailed description thereof will be omitted. Further, only the structure of the base portion 51C is different between the discharge container 1 according to the fourth embodiment and the discharge container 1 according to the first embodiment. Therefore, a detailed description of the other structure will be omitted.

As shown in FIG. 12, the base portion 51C used for the discharge container 1 includes the outer tube 61, the inner tube 62, the wall portion 63, an annular plate-like bottom wall 64C provided at the other end portion of the inner tube 62.

The bottom wall 64C is formed in an annular shape. The bottom wall 64C includes the discharge port 64*a*, the valve seat 64*b*, the groove 64*c*, the flow port 64*d*, and a plurality of, for example, three flow grooves 64*e* continuous with the flow port 64*d*. That is, the base portion 51C according to the fourth embodiment is provided with three flow grooves 64*e*. In this respect, the base portion 51C is different from the base portion 51 according to the first embodiment having one flow groove 64*e* provided in one flow port 64*d*.

The three flow grooves 64*e* are arranged in the inner surface on the radial center side of the groove 64*c* and at equal intervals in the circumferential direction of the flow port 64*d*. The flow grooves 64*e* are formed so that the depth from the main surface on the wall portion 63 side of the bottom wall 64 is more than that from the main surface to the bottom surface of the groove 64*c*. In other words, the flow grooves 64*e* extend beyond the bottom surface of the groove 64*c* to the flow port 64*d*.

The flow groove 64*e* constitutes the channel continuous from the valve chamber 54 to the flow port 64*d*. The flow groove 64*e* is formed so that the depth in the radial direction from the inner surface on the radial center side of the groove 64*c* is a predetermined depth. Here, the predetermined depth is the depth of the flow groove 64*e* in which the contents 100 can close the gap generated between the inner peripheral surface of the support portion 81 and the flow groove 64*e* when the support portion 81 to be described below of the check valve 53 is disposed in the groove 64*c*. At this time, the air flow is prevented by the surface tension of the contents 100. Therefore, the depth in the radial direction of the flow groove 64*e* from the outer peripheral surface of the groove 64*c* is appropriately set by the contents 100 stored in the discharge container 1.

Similarly to the discharge container 1 having the base 51 according to the first embodiment, the discharge container 1 having the base portion 51C structured as described above can prevent liquid dripping during use. In addition, a total opening area of the flow groove 64*e* is increased. Thus, it is possible to reliably suck the contents 100.

Fifth Embodiment

Next, a structure of a base portion 51D used in the discharge container 1 according to a fifth embodiment of the present invention will be described with reference to FIG. 13.

Figure 13:
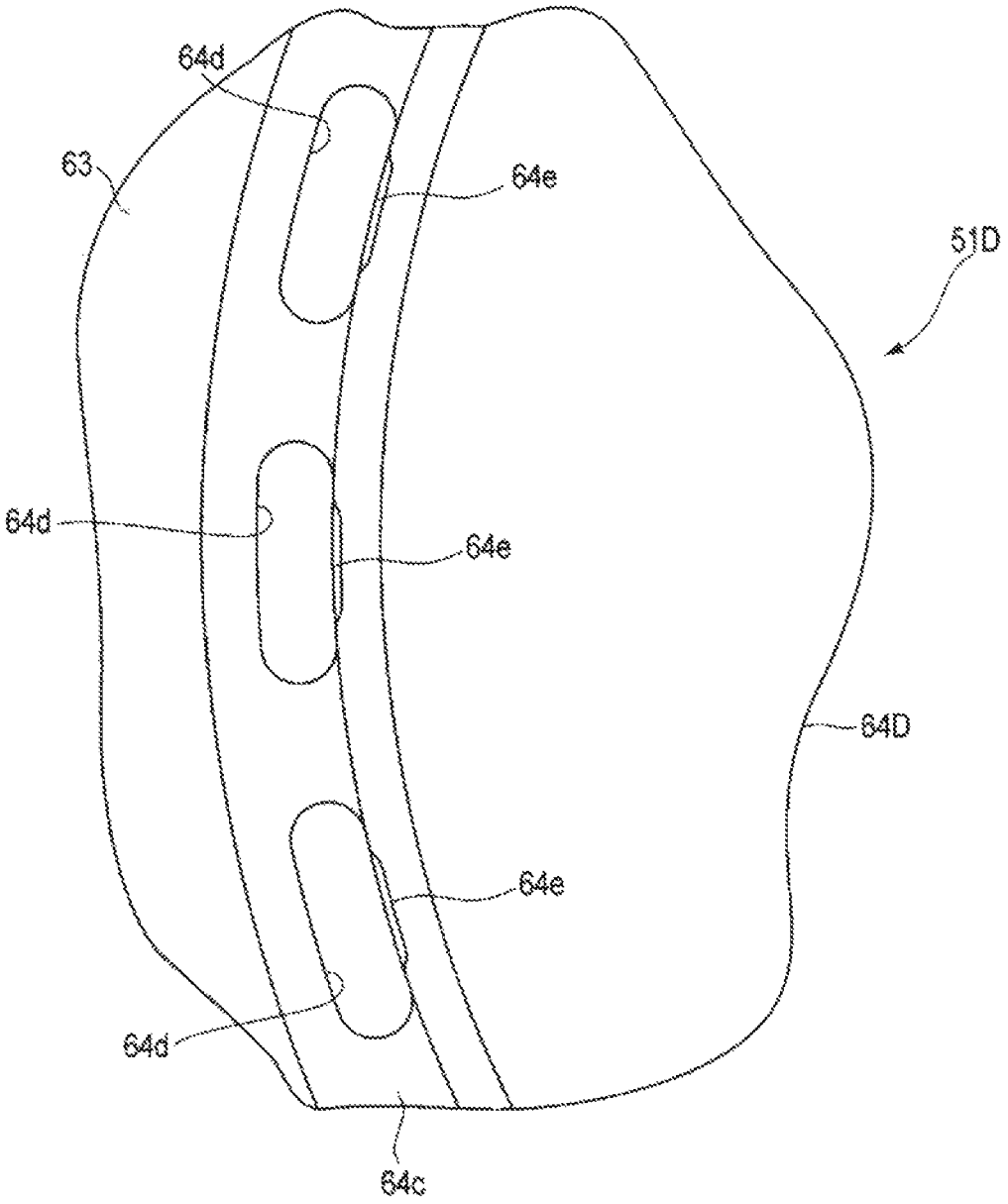
FIG. 13 is a plan view showing a structure of a base portion of a cap used for a discharge container according to a fifth embodiment of the present invention.

FIG. 13 is a plan view partially showing the structure of the base portion 51D used in the discharge container 1 according to the fifth embodiment of the present invention. In the structure of the discharge container 1 according to the fifth embodiment, the same reference numerals are given to the same components as those of the discharge container 1 according to the first embodiment described above. Then, a detailed description thereof will be omitted. Further, only the structure of the base portion 51D is different between the discharge container 1 according to the fifth embodiment and the discharge container 1 according to the first embodiment. Therefore, the detailed description of the other structure will be omitted.

As shown in FIG. 13, the base portion 51D used for the discharge container 1 includes the outer tube 61, the inner tube 62, the wall portion 63, an annular plate-like bottom wall 64D provided at the other end portion of the inner tube 62.

The bottom wall 64D is formed in an annular shape. The bottom wall 64D includes the discharge port 64*a*, the valve seat 64*b*, the groove 64*c*, a plurality of, for example, three flow ports 64*d*, and a plurality of, for example, three flow grooves 64*e* respectively provided in a plurality of flow ports 64*d*. That is, the base portion MD according to the fifth embodiment is provided with three flow ports 64*d* and three flow grooves 64*e*. In this respect, the base portion MD is different from the base portion 51 according to the first embodiment having one flow groove 64*e* provided in one flow port 64*d*.

The three flow ports 64*d* are provided adjacent to each other. For example, the flow ports 64*d* and the flow grooves 64*e* are arranged at positions opposite to the hinge 42 across the central axis of the cap 11.

The three flow grooves 64*e* are provided in the inner surface on the radial center side of the groove 64*c* and at the center in the circumferential direction of the flow port 64*d*. The flow grooves 64*e* are formed so that the depth from the main surface on the wall portion 63 side of the bottom wall 64 is more than that from the main surface to the bottom surface of the groove 64*c*. In other words, the flow grooves 64*e* extend beyond the bottom surface of the groove 64*c* to the flow port 64*d*.

Similarly to the discharge container 1 having the base 51 according to the first embodiment, the discharge container 1 having the base portion 51D structured as described above can prevent liquid dripping during use. In addition, with the discharge container 1 having the base portion MD, the total opening area of the flow groove 64*e* is increased similarly to the discharge container 1 having the base portion 51 according to the fourth embodiment described above. Thus, it is possible to reliably suck the contents 100.

It should be noted that the present invention is not limited to the above embodiments. In the above example, the container main body 10 is described as a double container having an outer container 21 and an inner container 22. However, the container main body 10 is not limited to this example. The container main body 10 may be, for example, a tube container or the like made of a resin material having a small restoring force. That is, the container main body 10 may have a restoring force in which when the outer container 21 is restored after deformation by the pressing force, the container main body 10 does not suck the air from any of the flow port 64*d*, the flow grooves 64*e*, 81*b*, and 62*b*, but can suck only the contents 100 from the flow port 64*d*, the flow grooves 64*e*, 81*b*, and 62*b*, and further, the flow grooves 64*e*, 81*b*, and 62*b* can be sealed by the surface tension of the contents 100.

Further, in the above-described example, the flow port 64*d* is formed so that its radial width is less than the radial width of the groove 64*c*. Further, the flow port 64*d* is formed to be provided on the outer peripheral surface side of the groove 64*c*. However, the flow port 64*d* is not limited to this example. The flow port 64*d* may be appropriately set to have the opening area larger than the flow groove 64*e* and have the size not closing the opening even when the burrs are generated at the time of molding the base portion 51, and further set such that the contents 100 sucked from the flow groove 64*e* can be moved to the inner container 22.

Further, in the above-described example, in the first embodiment, the structure has been described in which the flow groove 64*e* continuous with the opening end opened at the groove 64*c* of the flow port 64*d* is provided at the center in the circumferential direction of the flow port 64*d* on the outer peripheral surface of the groove 64*c*. Further, in the fourth embodiment, the structure has been described in which the three flow grooves 64*e* are provided at equal intervals in the circumferential direction of the flow port 64*d*. Furthermore, in the fifth embodiment, the structure has been described in which one flow groove 64*e* is provided in each of the three flow ports 64*d*. However, the flow groove 64*e* is not limited to these examples. For example, the flow grooves 64*e* may be provided on both circumferential end portion sides of the flow port 64*d*. That is, the flow groove 64*e* may be configured to suck the contents 100 remaining in the valve chamber 54 when the outer container 21 is restored, and to have the channel cross-sectional area in which the air does not enter the container main body 10 by sealing the flow groove 64*e* by the surface tension of the contents 100 when the restoration of the outer container 21 is completed. The position, shape, size, and the like of the flow groove 64*e* can be appropriately set within a range having the above function depending on the characteristics of the contents 100 and characteristics of the container main body 10.

Figure 14:
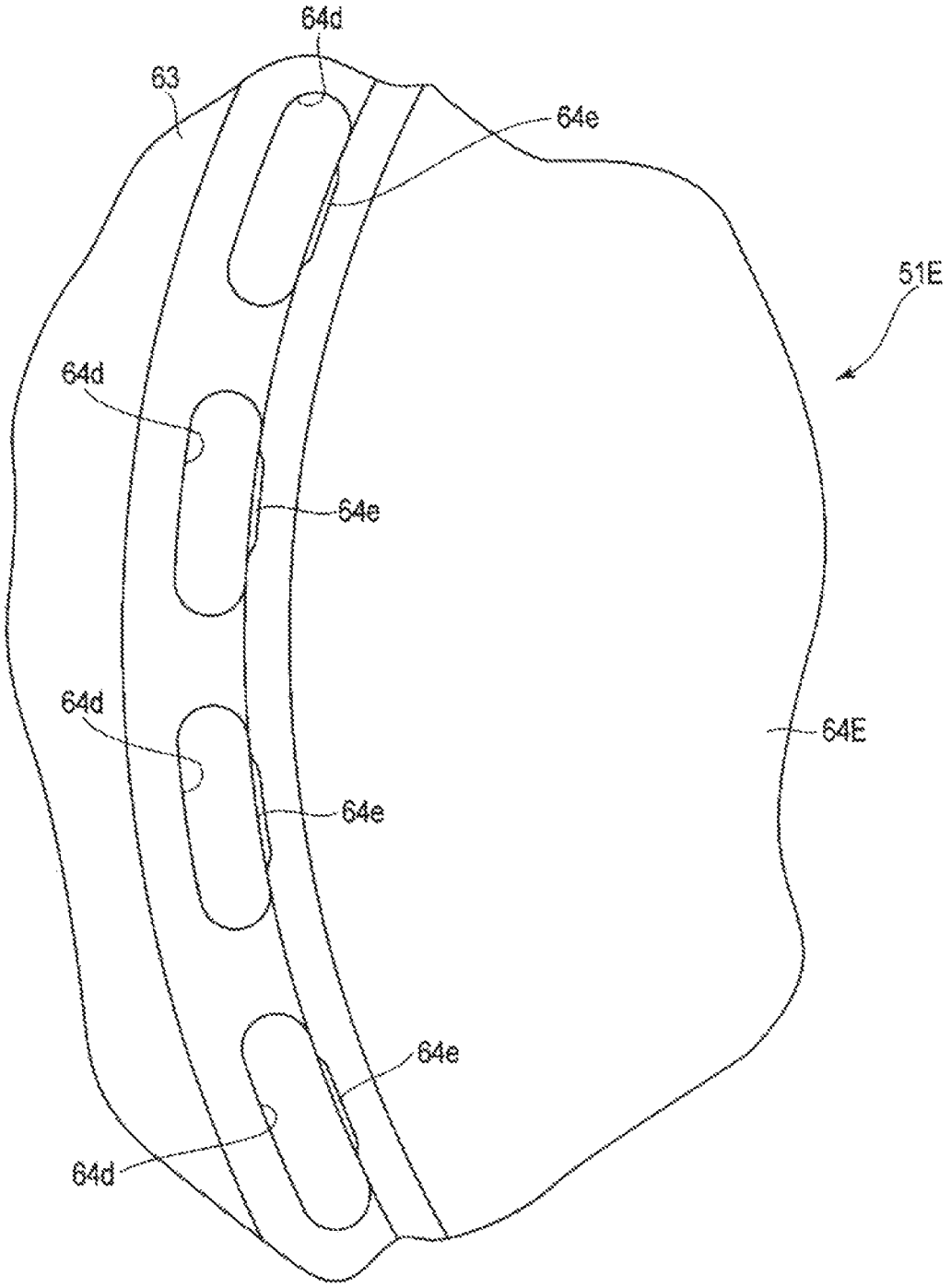
FIG. 14 is a plan view showing a structure of a base portion of a cap used for a discharge container according to a first modification of the present invention.

As a specific example, like a bottom wall 64E of a base portion 51E according to a first modification shown in FIG. 14, the bottom wall 64 may include four flow ports 64*d* and flow grooves 64*e* respectively provided in the flow ports 64*d*.

Figure 15:
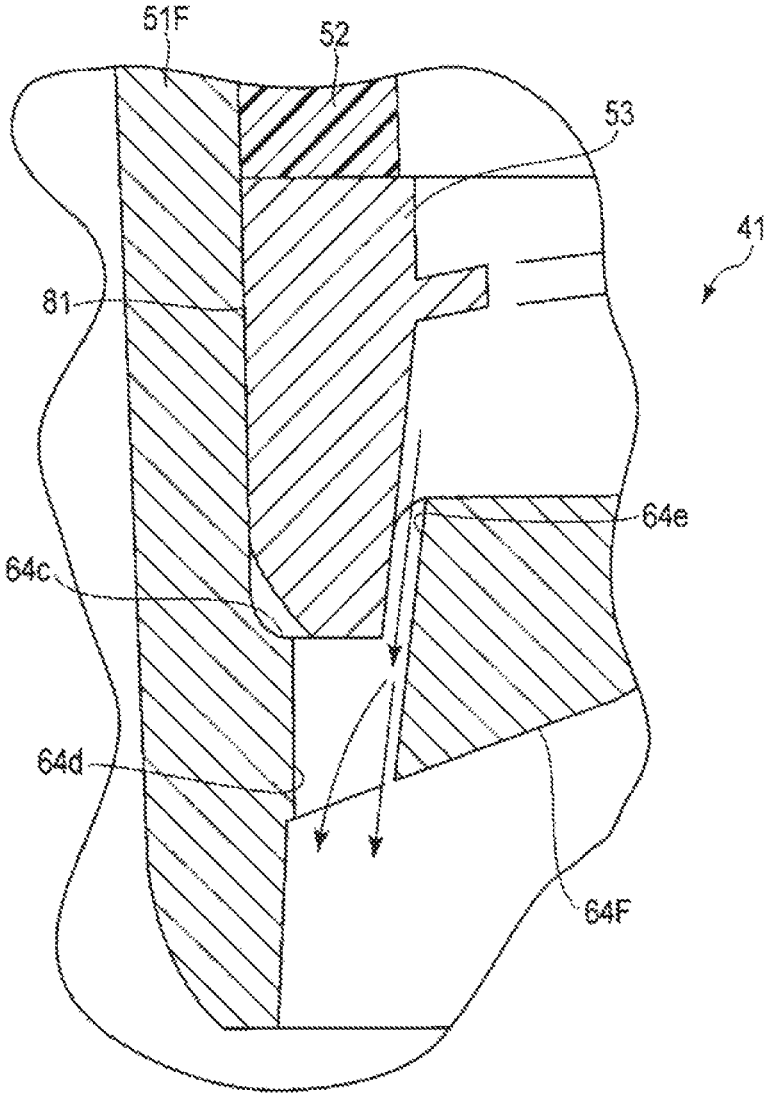
FIG. 15 is an enlarged cross-sectional view showing a structure of a main part of a cap used for a discharge container according to a second modification of the present invention.

Further, like a bottom wall 64F of a base portion 51F according to a second modification shown in FIG. 15, the flow groove 64*e* may not be continuous with the opening end opened at the groove 64*c* of the flow port 64*d*. That is, the flow groove 64*e* may be continuous with the opening end opened at the inner container 22 of the flow port 64*d*. In such a bottom wall 64F, as shown by arrows, a portion of the contents 100 sucked from the flow groove 64*e* can move linearly from the groove 64*c* to the inner container 22. At the same time, the other portion of the contents 100 can move to spread radially at the flow port 64*d*. Thus, in the discharge container 1, the contents 100 smoothly move during liquid suction. As a result, the movement of the contents 100 is not hindered.

Figure 16:
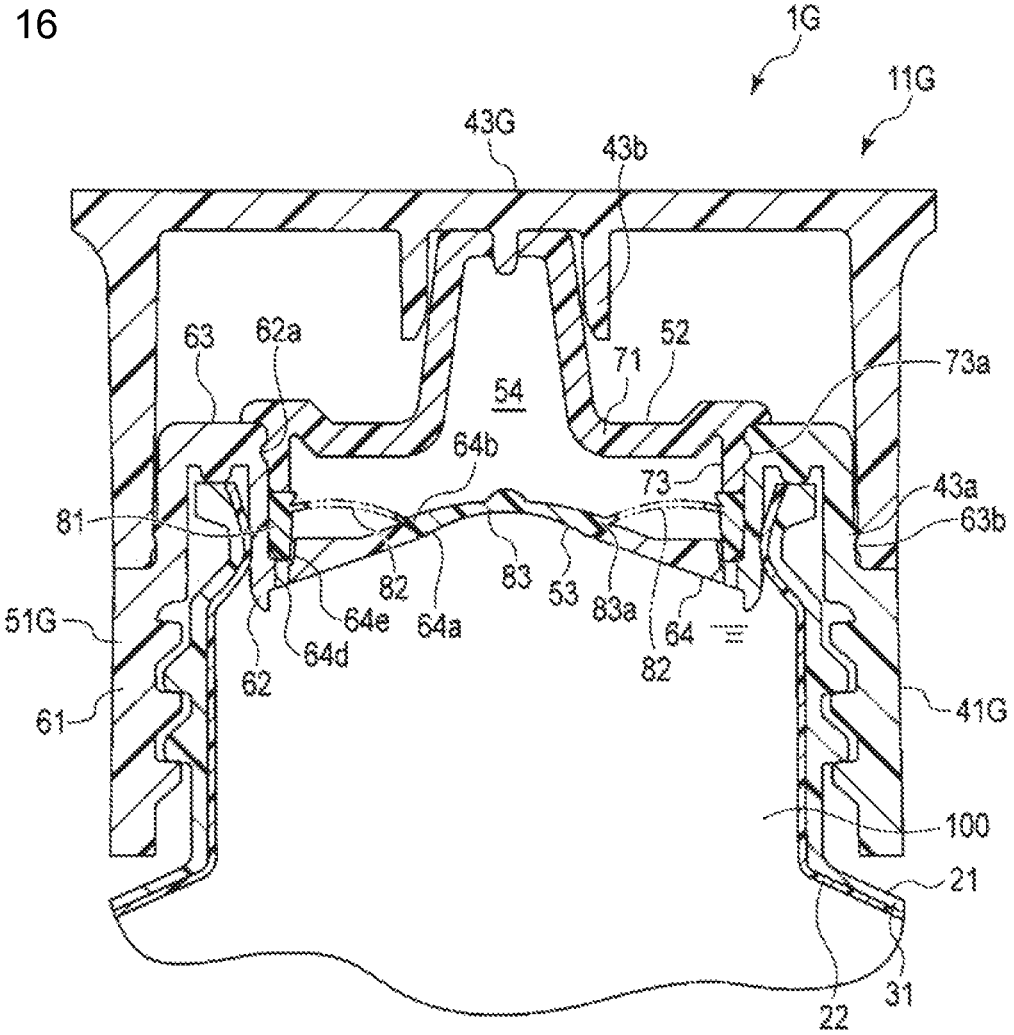
FIG. 16 is a cross-sectional view showing a structure of a discharge container according to a third modification of the present invention.
Figure 17:
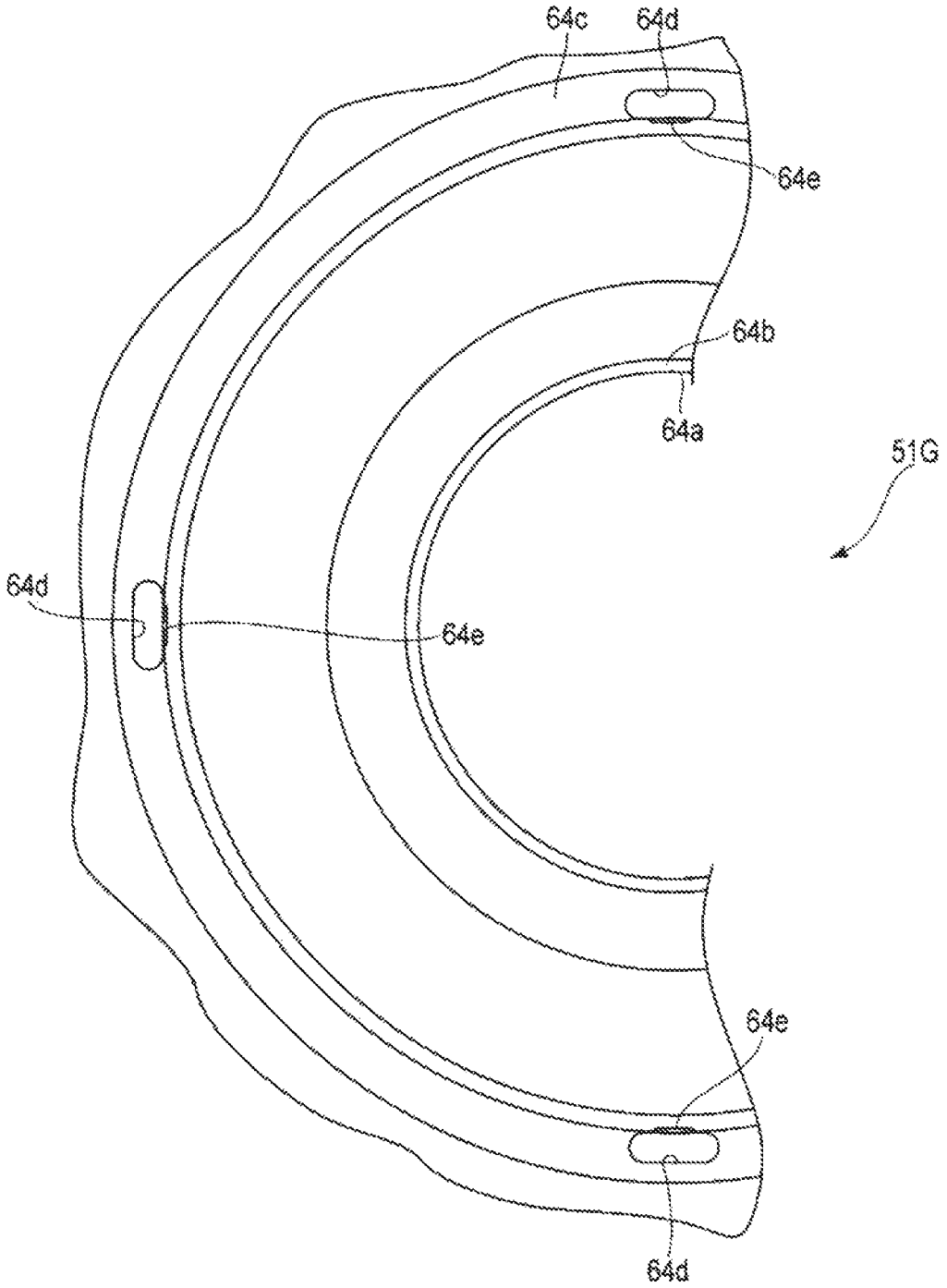
FIG. 17 is a plan view showing a structure of a base portion of a cap used for the discharge container.

In the above-described example, the cap 11 of the discharge container 1 includes the cap main body 41 and the lid body 43 connected to the cap main body 41 via the hinge 42. However, the cap 11 is not limited to this example. For example, as shown in FIGS. 16 and 17 as a third modification, a cap 11G may not to have the hinge 42. For example, a cap main body 41G may be provided with an annular engaging portion 63*b* projecting in the radial direction on an outer peripheral surface thereof. Further, the lid body 43G may be provided with an annular engaged portion 43*a* projecting in the radial direction, which is engaged with the engaging portion 63*b*, on the inner peripheral surface thereof.

Further, with respect to the cap 11G having such a structure, a direction in which the discharge container 1G is inclined at the time of use cannot be specified. Therefore, as shown in FIG. 17, a base portion 51G may be provided with four flow ports 64*d* at equal intervals, for example, at 90° intervals, and the flow groove 64*e* may be provided in each of the flow ports 64*d*, so that the liquid suction of the contents 100 uniformly occurs in the groove 64*c*. By providing such a base portion 51G, even when the direction of inclination of the discharge container 1 cannot be specified, it is possible to suck liquid contents 100 from any one of the flow ports 64*d* and the flow grooves 64*e*.

The structure of the cap 11 is not limited to the third modification described above. For example, the cap 11 not having the hinge 42 may be configured such that the lid body 43 is fixed to the cap main body 41 by screwing a male screw provided on the cap main body 41 into a female screw provided on the lid body 43.

It should be noted that the present invention is not limited to the above embodiments. At an implementation stage, various modifications can be made without departing from the gist thereof. Further, respective embodiments may be appropriately combined as much as possible and implemented. In that case, a combination effect is obtained. Furthermore, the above embodiments include inventions at various stages. Therefore, various inventions can be extracted from suitable combinations of a plurality of disclosed constituent features.

The invention claimed is:

1. A cap provided on a mouth portion of a container main body which is deformed by a pressing force and stores contents, comprising:

a base portion having an annular bottom wall having a discharge port, an annular groove provided in an outer peripheral edge of the bottom wall, a flow port provided in the groove, and a flow groove connected to the flow port;

a check valve having a cylindrical support portion having one end disposed in the groove, a plurality of elastic pieces connected to the support portion, and a valve body connected to the plurality of elastic pieces and opening and closing the discharge port; and a discharge nozzle covering the bottom wall.

2. The cap according to claim 1, wherein the groove is provided closer to a container than the discharge port in an axial direction of the base portion.

3. The cap according to claim 1, further comprising a lid body integrally provided on the base portion via a hinge, wherein the flow port and the flow groove are arranged at positions opposite to the hinge across a center of the base portion.

4. The cap according to claim 1, wherein the flow groove is provided in plurality in the flow port.

5. A discharge container comprising:

a cap according to claim 1, and a container main body having an outer container having a mouth portion to which the cap is fixed, and an inner container provided in the outer container and deforming as the outer container deforms.

6. The cap according to claim 1, wherein the flow groove is formed in an inner side surface on a center side in a radial direction of the groove.

7. The cap according to claim 6, wherein the flow groove is formed to have a circumferential length shorter than that of the flow port and is disposed at a center in a circumferential direction of the flow port.

8. The cap according to claim 1, wherein the flow port is provided in plurality, and the flow groove is provided in each of the flow ports.

9. The cap according to claim 8, further comprising a lid body fixed to the base portion, wherein the flow ports are arranged at regular intervals.

10. A cap provided on a mouth portion of a container main body which is deformed by a pressing force and stores contents, comprising:

a base portion having an annular bottom wall having a discharge port, an annular groove provided in an outer peripheral edge of the bottom wall, and a flow port provided in the groove;

a check valve having a cylindrical support portion having one end disposed in the groove, a plurality of elastic pieces connected to the support portion, a valve body connected to the plurality of elastic pieces and opening and closing the discharge port, and a flow groove provided in the support portion and connected to the flow port; and a discharge nozzle covering the bottom wall.

11. The cap according to claim 10, further comprising a lid body integrally provided on the base portion via a hinge, wherein the flow port is disposed at a position opposite to the hinge across a center of the base portion, the flow groove is formed to have a circumferential length shorter than that of the flow port, and the flow groove is provided in plurality in an outer peripheral surface of the support portion or the single flow groove is provided to face the flow port.

12. A discharge container comprising:

a cap according to claim 10, and a container main body having an outer container having a mouth portion to which the cap is fixed, and an inner container provided in the outer container and deforming as the outer container deforms.

* * * * *